US006672551B2

(12) United States Patent
Rivellino et al.

(10) Patent No.: US 6,672,551 B2
(45) Date of Patent: Jan. 6, 2004

(54) DEVICE FOR HANGING ARTICLES

(76) Inventors: Ernest Rivellino, 5591 NW. 3rd Ter., Boca Raton, FL (US) 33487; Michael Rivellino, 5591 NW. 3rd Ter., Boca Raton, FL (US) 33487

( * ) Notice: Subject to any disclaimer, the term of this patent is extended or adjusted under 35 U.S.C. 154(b) by 0 days.

(21) Appl. No.: 09/934,425

(22) Filed: Aug. 21, 2001

(65) Prior Publication Data

US 2002/0050548 A1 May 2, 2002

Related U.S. Application Data

(60) Provisional application No. 60/244,174, filed on Oct. 31, 2000.

(51) Int. Cl.[7] ..... A47G 1/17

(52) U.S. Cl. ..... 248/206.5; 248/304; 248/467; 248/470; 248/475.1; 248/489

(58) Field of Search ..... 248/683, 206.5, 248/267, 470, 304, 467, 489, 475.1, 495, 693

(56) References Cited

U.S. PATENT DOCUMENTS

| | | | | | |
|---|---|---|---|---|---|
| 2,049,716 | A | * | 8/1936 | Owen | 248/549 |
| 2,679,998 | A | * | 6/1954 | Keller | 248/205.3 |
| 3,433,449 | A | * | 3/1969 | Musante | 248/297 |
| 3,604,673 | A | * | 9/1971 | Klein | 248/467 |
| 3,908,955 | A | * | 9/1975 | Frechtman | 248/470 |
| 4,455,756 | A | * | 6/1984 | Greene | 33/613 |
| 4,544,067 | A | * | 10/1985 | Miller | 211/70.6 |
| 4,893,776 | A | * | 1/1990 | Floyd | 248/475.1 |
| 5,110,077 | A | * | 5/1992 | Mossini | 248/205.3 |
| 5,269,083 | A | * | 12/1993 | Vampatella | 40/124.1 |
| 5,398,906 | A | * | 3/1995 | Aydelott | 248/547 |
| 5,417,397 | A | * | 5/1995 | Harnett | 248/309.4 |
| 5,642,871 | A | * | 7/1997 | Repert | 248/686 |
| 5,760,668 | A | * | 6/1998 | Testa et al. | 335/285 |
| 6,176,033 | B1 | * | 1/2001 | Latwesen | 42/4.5 |
| 6,216,888 | B1 | * | 4/2001 | Chien | 211/87.01 |
| 6,241,210 | B1 | * | 6/2001 | Brindisi | 248/476 |

FOREIGN PATENT DOCUMENTS

GB 2 191 089 A 12/1987

* cited by examiner

*Primary Examiner*—Ramon Q. Ramirez
*Assistant Examiner*—Amy J. Sterling
(74) *Attorney, Agent, or Firm*—Akerman Senterfitt

(57) ABSTRACT

A device for hanging an article with a portion having magnetic susceptibility, including: a base member for attaching the device to a structure; an engagement structure for engaging the article, wherein the engagement structure is attached to the base member; and a magnetic member coupled to the base member, wherein at least a portion of the magnetic member comprises magnetic material, the magnetic material being positioned on the magnetic member to attract the portion of the article having magnetic susceptibility so as to facilitate the engaging of the article to the engagement structure. Alternatively, the device for hanging an article with a portion having magnetic susceptibility, includes: a base member for attaching the device to a structure; the base member having engagement structure for engaging the article; and at least a portion of the base member comprising magnetic material, the magnetic material being positioned on the base member to attract the portion of said article having magnetic susceptibility so as to facilitate the engaging of the article to the engagement structure.

10 Claims, 4 Drawing Sheets

DEVICE FOR HANGING ARTICLES

CROSS-REFERENCE TO RELATED APPLICATIONS

This application claims priority from U.S. patent application No. 60/244,174 filed on Oct. 31, 2000.

STATEMENT REGARDING FEDERALLY SPONSORED RESEARCH OR DEVELOPMENT (not applicable)

BACKGROUND

1. Technical Field

This invention relates generally to devices for supporting objects and, more particularly, to hanging devices for supporting decorative articles.

2. Description of Related Art

Many different types of devices have been used for hanging articles such as decorative objects. As an example, many hanging devices include a base which can be secured to a wall and a hook portion attached to the base. The hook portion can be used to support a number of decorative objects such as paintings, photographs, mirrors or other works of art. These decorative objects typically include a hanging element such as a wire that is attached to opposite ends of the object and stretches across the back of the object. To support the decorative object, the hanging element is placed above the hook portion and is lowered until the hook portion engages or catches the hanging element.

Significantly, however, this process of engaging the hook portion with the hanging element can be difficult and time consuming. For example, in most cases, the hanging element does not rise above the top of the decorative object, and the person attempting to hang the object is unable to see the hook portion or the hanging element. Moreover, many of the hanging elements are bendable and movable further complicating the attempt to secure the hanging element to the hook portion. Thus, what is needed is a hanging device which simplifies the process of hanging objects without presenting significant increases in complexity or costs.

SUMMARY OF THE INVENTION

The present invention concerns a device for hanging an article with a portion having magnetic susceptibility. A device includes: a base member for attaching the device to a structure; an engagement structure for engaging the article in which the engagement structure is attached to the base member; and a magnetic member coupled to the base member in which at least a portion of the magnetic member contains magnetic material. The magnetic material is positioned on the magnetic member to attract the portion of the article having magnetic susceptibility so as to facilitate the engaging of the article to the engagement structure. The engagement structure can be used to support a number of decorative objects such as paintings, photographs, mirrors or other works of art. In one arrangement, the base member and the magnetic member can each contain at least one aperture for receiving at least one fastener. In addition, the apertures of the base member and the magnetic member can be positioned in such a way as to guide the receipt of the fastener in accordance with a range from approximately a twenty degree angle to approximately a seventy degree angle.

In one aspect, the magnetic material can be positioned on an outer surface of the magnetic member or alternatively, in the interior of the magnetic member. If the magnetic material is to be positioned in the interior of the magnetic member, then the magnetic member can further include a cavity for receipt of the magnetic material. In another arrangement, the magnetic material can be positioned above a highest point of the engagement structure.

In an alternative arrangement of the invention, the device includes: a base member for attaching the device to a structure in which the base member has engagement structure for engaging the article; and at least a portion of the base member comprising magnetic material in which the magnetic material is positioned on the base member to attract the portion of the article having magnetic susceptibility so as to facilitate the engaging of the article to the engagement structure. The engagement structure can be used to support a number of decorative objects such as paintings, photographs, mirrors or other works of art. In one aspect, the base member can contain at least one aperture for receiving at least one fastener. In addition, the aperture of the base member can be positioned in such a way as to guide the receipt of said fastener in accordance with a range from approximately a twenty degree angle to approximately a seventy degree angle.

In one arrangement, the magnetic material can be positioned on an outer surface of the base member or alternatively, can be positioned in the interior of the base member. If the magnetic material is to be positioned in the interior of the base member, then the base member can further include a cavity for receipt of the magnetic material. In another arrangement, the magnetic material can be positioned above a highest point of the engagement structure.

DETAILED DESCRIPTION OF THE PREFERRED EMBODIMENT

Figure 1:
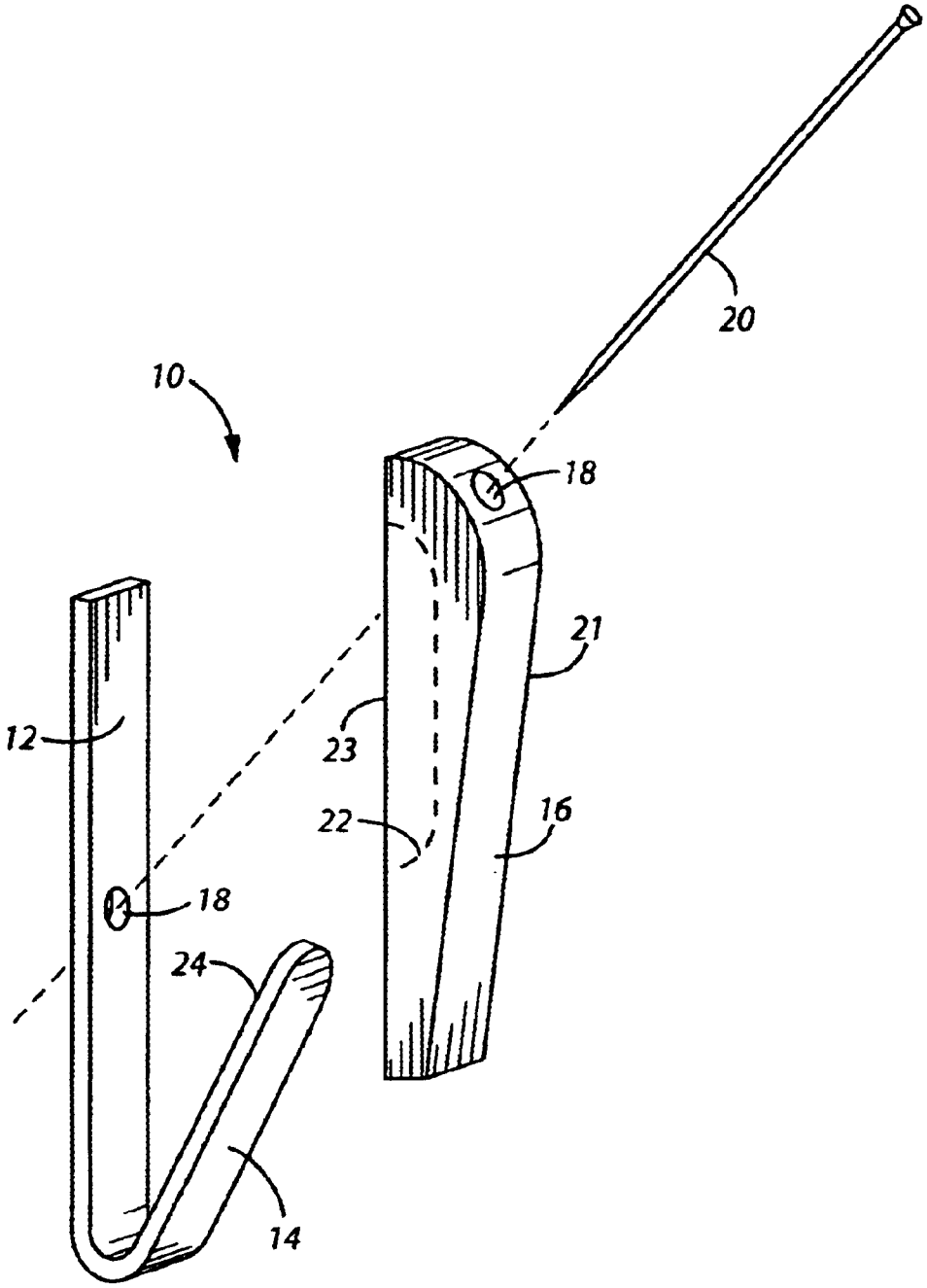
FIG. 1 is a perspective view of a device for hanging articles in accordance with the inventive arrangements.

FIG. 1 illustrates a device 10 for hanging an article (not shown) in which a portion of the article has magnetic susceptibility. The device 10 can include a base member 12 and a magnetic member 16. The base member 12 can be used to attach the device 10 to a structure such as a wall. Additionally, the base member 12 can include an engagement structure 14, which can be used to engage the article. The magnetic member 16 can be coupled to the base member 12, and at least a portion of the magnetic member 16 can comprise magnetic material (not shown). In one arrangement, the magnetic member 16 can contain a slot (not shown) for receiving the base member 12. The magnetic material can be positioned on the magnetic member 16 to attract the portion of the article having magnetic susceptibility so as to facilitate the engaging of the article to the engagement structure 14.

In one arrangement, the base member 12 and the magnetic member 16 can each include at least one aperture 18 for receiving one or more fasteners 20. The fastener 20 can be used for purposes of attaching the device 10 to the structure, e.g., a wall. It should be noted that any suitable fastener 20 can be used. In addition, the apertures 18 can be positioned in such a way as to guide the receipt of the fastener 20 in accordance with a range from approximately a twenty degree angle to approximately a seventy degree angle; however, it is understood that the invention is not limited to this particular arrangement, as the apertures 18 can be positioned in any other suitable location.

Referring to the magnetic member 16, the magnetic member 16 can be composed entirely or substantially composed of magnetic material. In addition, magnetic material can be positioned at any suitable location on the magnetic member 16. For example, the magnetic material can be located directly on an outer surface 21 of the magnetic member 16, or can be located in the interior of the magnetic member 16. To enable the magnetic material to be placed in the interior of the magnetic member 16, the magnetic member 16 can include a cavity 22 represented by the dashed lines for receiving the magnetic material. The cavity 22 can also include an opening 23 thereby permitting a user to place a suitable amount of magnetic material in the cavity 22. Although FIG. 1 illustrates the opening 23 as being located on the side of the magnetic member 16 facing the base member 12, the invention is not so limited. In fact, the opening 23 can be at any other suitable location on the magnetic member 16. Moreover, the cavity 22 need not contain an opening 23, as the magnetic material can be placed in the cavity 22 during the manufacturing process. No matter where the magnetic material is placed (outside surface or interior of the magnetic member 16), the magnetic material can be positioned such that it is above the highest point of the engagement structure 14. In addition, it should be noted that the magnetic material can be any material capable of attracting the portion of the article having magnetic susceptibility.

The engagement structure 14 can be any type of structure capable of supporting the article. For example, the engagement structure 14 can be a hook, like the one shown in FIG. 1. In one arrangement, at least a portion of the engagement structure 14 can extend upwardly away from the base member 12 or upwardly in a direction substantially parallel to the base member 12 in order to prevent the article from slipping off the engagement structure 14 once the engagement structure 14 has received the article. In another arrangement, the engagement structure 14 can include an interior surface 24.

Figure 2:
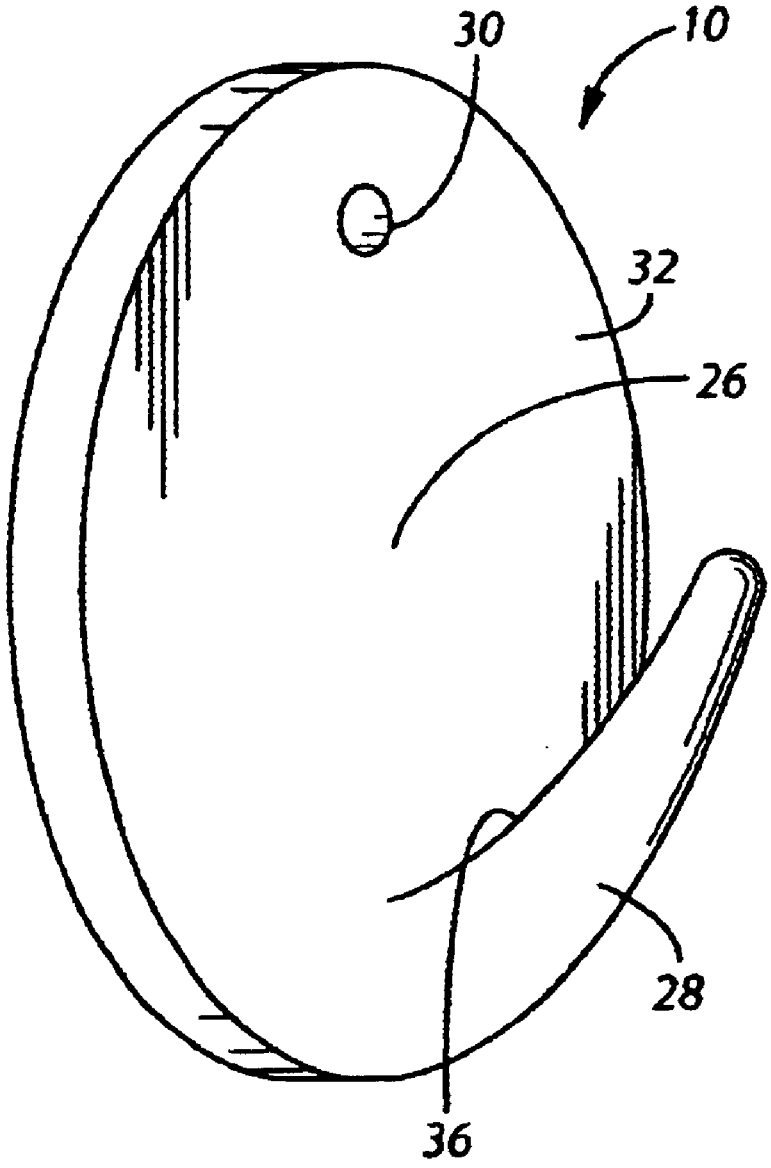
FIG. 2 is a perspective view of a device for hanging articles in accordance with the inventive arrangements.

FIG. 2 shows an alternative arrangement of the device 10 of FIG. 1. As shown, a base member 26 can be a single molded piece containing an engagement structure 28. In addition, magnetic material can be positioned on the base member 26 for attracting the portion of the article having magnetic susceptibility so as to facilitate the engaging of the article to the engagement structure 28. The base member 26 can also have at least one aperture 30 for receiving one or more fasteners (not pictured). Similar to the device 10 of FIG. 1, the aperture 30 can be positioned in such a way as to guide the receipt of the fastener in accordance with a range from approximately a twenty degree angle to approximately a seventy degree angle. It should be noted, however, that the invention is not limited in this regard, as the aperture 30 can be positioned to guide the receipt of the fastener in accordance with any other suitable angle.

Figure 3:
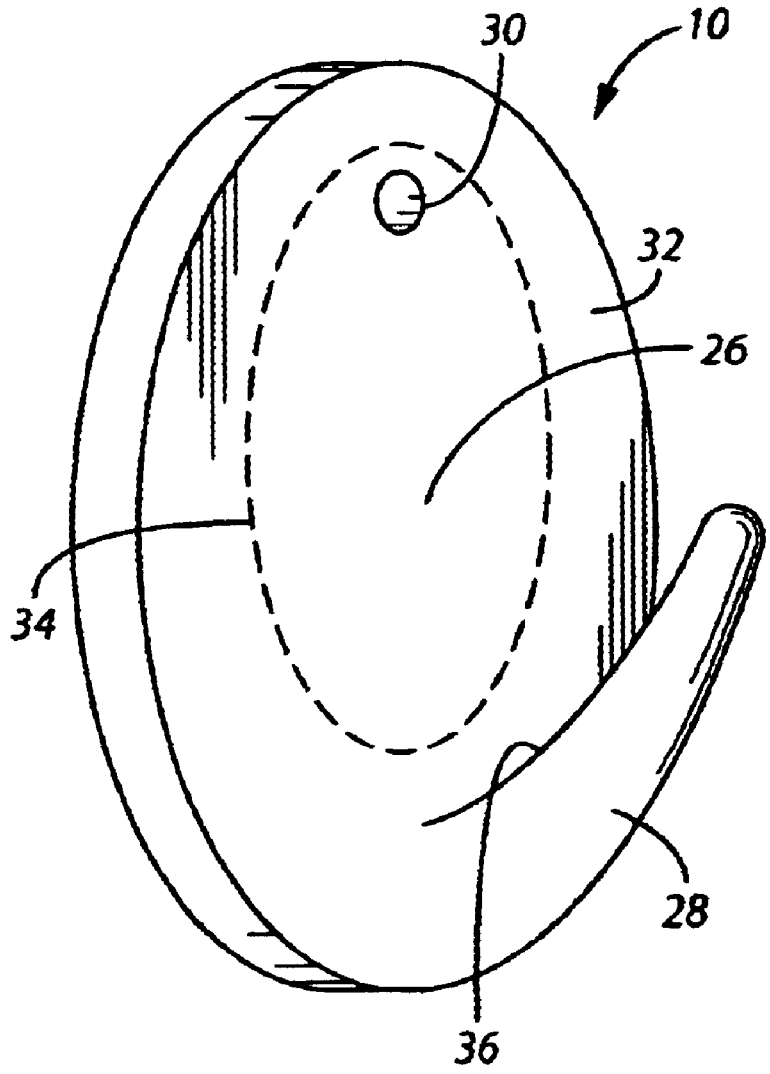
FIG. 3 is a perspective view of a device for hanging articles with a cavity for receiving magnetic material.

Continuing with FIG. 2, the magnetic material can be positioned at any suitable location on the base member 26. For example, the magnetic material can be located directly on an outer surface 32 of the base member 26 or can be located in the interior of the base member 26. Referring to FIG. 3, in this particular arrangement, the base member 26 can contain a cavity 34 represented by the dashed lines and an opening (not shown) for receiving the magnetic material should it be desired to store the magnetic material within the interior of the base member 26. Further, the opening can be located at any suitable location on the base member 26, or alternatively, the magnetic material can be placed inside the base member 26 during the manufacturing process thereby eliminating the need for the opening. Further, in one embodiment, the magnetic material can be located on an area of the base member 26 such that the magnetic material is above the highest point of the engagement structure 28. Similar to the device 10 of FIG. 1, the magnetic material can be any material capable of attracting the portion of the article having magnetic susceptibility.

The engagement structure 28 can be any type of structure capable of supporting the article such as a hook. At least a portion of the engagement structure 28 can extend upwardly away from the base member 26 or upwardly in a direction substantially parallel to the base member 26 in order to prevent the article from slipping off the engagement structure 28 once the engagement structure 28 has received the article. As shown in FIGS. 2 and 3, the engagement structure 28 can also include an interior surface 36.

Figure 4:
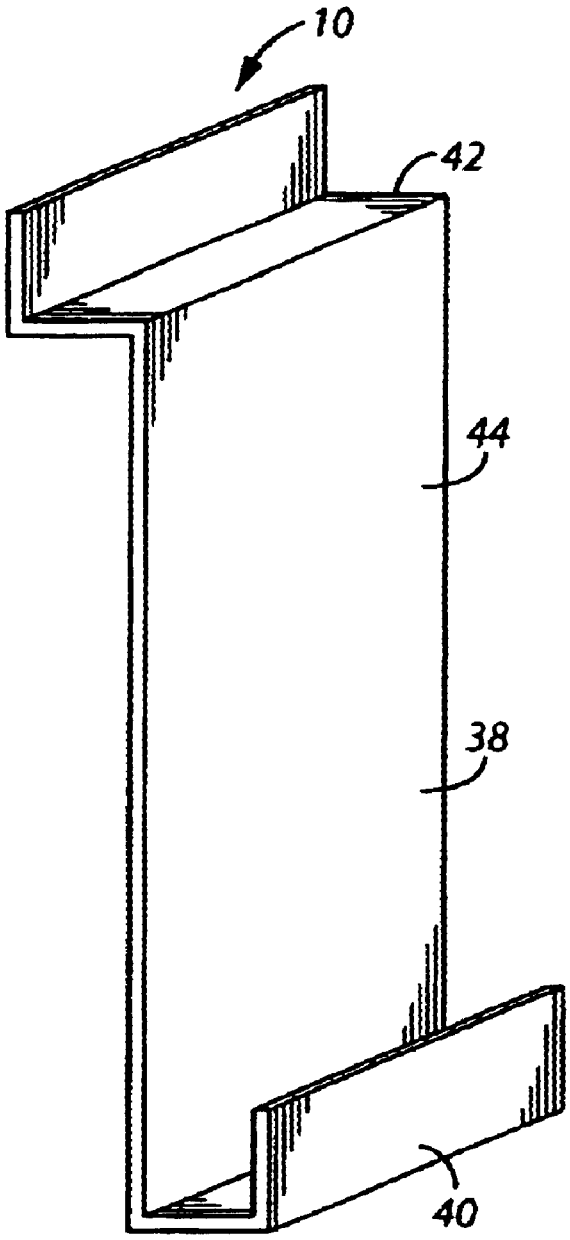
FIG. 4 is a perspective view of a device for hanging articles in accordance with the inventive arrangements.

FIG. 4 shows another embodiment of the present Invention. This particular embodiment may be useful in art galleries where relatively large pieces of art may be displayed. As shown, the device 10 can include the base member 38, which can include the engagement structure 40 and an adapting structure 42. The adapting structure 42 can be used for purposes of engaging structure designed to support decorative objects such as a slat board or other related structures. Similar to the embodiments discussed above, the magnetic material can be positioned at any suitable location on the base member 38 such as the outer surface 44 of the base member 38 or the interior of the base member 38. In addition, the magnetic material can be positioned such that it is above the highest point of the engagement structure 40.

It should be understood that the examples and embodiments described herein are for illustrative purposes only and that various modifications or changes in light thereof will be obvious to persons skilled in the art and are to be included within the spirit and purview of this application. Moreover, the invention can take other specific forms without departing from the spirit or essential attributes thereof.

What is claimed is:

1. A device for hanging a decorative article with a hanging wire or loop portion having magnetic susceptibility, comprising:

a wall-engaging portion for attaching said device to a wall;

an upwardly directed non-magnetic hook for engaging said hanging wire or loop, wherein said hook is attached to said wall-engaging portion at a lower end of said wall-engaging portion, and has a free end defining a highest portion of the hook;

wherein a portion of said device comprises magnetic material, said magnetic material being positioned above said highest portion of said non-magnetic hook to attract the magnetically susceptible hanging wire or loop, whereby after attraction of the hanging wire or loop to the magnetic material, the hanging wire or loop can be slid downwardly into said hook so as to facilitate the engaging of said hanging wire or loop to said hook.

2. The device according to claim 1, further comprising a magnetic member coupled to said wall-engaging portion, wherein said magnetic material is incorporated in said magnetic member, and wherein said wall-engaging portion and said magnetic member each contain at least one aperture for receiving at least one fastener.

3. The device according to claim 2, wherein the apertures of said wall-engaging portion and said magnetic member are positioned in such a way as to guide the receipt of said fastener in accordance with a range from approximately a twenty degree angle to approximately a seventy degree angle.

4. The device according to claim 1, wherein said magnetic material is positioned on an outer surface of said device.

5. The device according to claim 1, wherein said magnetic material is positioned in the interior of said device.

6. The device according to claim 5, wherein said device further comprises a cavity for receipt of said magnetic material.

7. The device according to claim 1, wherein said magnetic material is positioned entirely above a highest point of said hook.

8. The device according to claim 1, wherein said wall-engaging portion is composed entirely of magnetic material.

9. The device according to claim 1, further comprising a downwardly inclined surface for guiding said hanging wire or loop portion into said engagement structure.

10. The device according to claim 2, wherein said magnetic member has a downwardly inclined surface for guiding said hanging wire or loop portion into said engagement structure.

* * * * *